US011437227B2

(12) United States Patent
Nishiguchi

(10) Patent No.: US 11,437,227 B2
(45) Date of Patent: Sep. 6, 2022

(54) QUADRUPOLE MASS SPECTROMETER

(71) Applicant: SHIMADZU CORPORATION, Kyoto (JP)

(72) Inventor: Masaru Nishiguchi, Kyoto (JP)

(73) Assignee: SHIMADZU CORPORATION, Kyoto (JP)

( * ) Notice: Subject to any disclaimer, the term of this patent is extended or adjusted under 35 U.S.C. 154(b) by 16 days.

(21) Appl. No.: 17/270,895

(22) PCT Filed: Sep. 6, 2018

(86) PCT No.: PCT/JP2018/033080
§ 371 (c)(1),
(2) Date: Feb. 24, 2021

(87) PCT Pub. No.: WO2020/049693
PCT Pub. Date: Mar. 12, 2020

(65) Prior Publication Data
US 2021/0183638 A1 Jun. 17, 2021

(51) Int. Cl.
*H01J 49/42* (2006.01)
*H01J 49/06* (2006.01)

(52) U.S. Cl.
CPC ..... *H01J 49/4215* (2013.01); *H01J 49/063* (2013.01)

(58) Field of Classification Search
CPC ..... H01J 49/4215; H01J 49/063
See application file for complete search history.

(56) References Cited

U.S. PATENT DOCUMENTS

2010/0193684 A1 8/2010 Mukaibatake et al.
2019/0051508 A1 2/2019 Miyauchi et al.

FOREIGN PATENT DOCUMENTS

JP 07-245080 A 9/1995
WO 2007/083403 A1 7/2007
WO 2017/094146 A1 6/2017

OTHER PUBLICATIONS

Communication dated Jan. 20, 2022, issued by the Japanese Patent Office in application No. 2020-540952.
International Search Report for PCT/JP2018/033080 dated Dec. 4, 2018 (PCT/ISA/210).
Written Opinion for PCT/JP2018/033080 dated Dec. 4, 2018 (PCT/ISA/237).

*Primary Examiner* — Nicole M Ippolito
*Assistant Examiner* — Hanway Chang
(74) *Attorney, Agent, or Firm* — Sughrue Mion, PLLC

(57) ABSTRACT

A quadrupole mass spectrometer includes: a quadrupole mass filter including a pre-rod; an ionization chamber; and an ion optical system that guides ions generated in the ionization chamber to the pre-rod of the quadrupole mass filter, wherein: a potential of an exit side electrode of the ion optical system is lower than a potential of the ionization chamber and a potential of the pre-rod of the quadrupole mass filter; and there is no structure that has a higher potential than the exit side electrode and decelerates the ions between the exit side electrode and the pre-rod.

12 Claims, 4 Drawing Sheets

QUADRUPOLE MASS SPECTROMETER

CROSS REFERENCE TO RELATED APPLICATIONS

This application is a National Stage of International Application No. PCT/W2018/033080 filed Sep. 6, 2018.

TECHNICAL FIELD

The present invention relates to a quadrupole mass spectrometer.

BACKGROUND ART

A quadrupole mass spectrometer is widely used as a mass spectrometer that is compact and has excellent sensitivity and analysis throughput. The quadrupole mass spectrometer is the device that performs mass analysis in which a DC voltage and an AC voltage are applied to four rod electrodes (main rods) called a quadrupole mass filter arranged around the central axis to generate an oscillating electric field so as to pass ions having a predetermined m/z (mass-to-charge ratio).

In order to perform analysis with high accuracy, it is necessary to efficiently inject the ions of analysis target into the quadrupole mass filter. Therefore, an ion optical system including an electrostatic lens is arranged between an ionization chamber, which is an ion source, and the quadrupole mass filter, and the ions generated in the ionization chamber are converged by the ion optical system and introduced into the quadrupole mass filter.

Further, a quadrupole mass spectrometer with improved incident efficiency of the ions of analysis target to the quadrupole mass filter, in which, a rod electrode called a pre-rod is provided at the upstream side of the main rod of the quadrupole mass filter and the emittance of the ion beam emitted from the pre-rod and the acceptance of the main rod are matched, is proposed (Patent Literature: PTL 1).

CITATION LIST

Patent Literature

PTL 1: International Publication No. 2017/094146

SUMMARY OF INVENTION

Technical Problem

Although the incident efficiency of ions to the quadrupole mass filter is improved in the quadrupole mass spectrometer of PTL 1, for more accurate analysis, the quadrupole mass spectrometer of PTL 1 is still insufficient in the incident efficiency of ions, and further improvement of the incident efficiency is required.

Solution to Problem

A quadrupole mass spectrometer according to the 1st aspect includes: a quadrupole mass filter including a pre-rod; an ionization chamber; and an ion optical system that guides ions generated in the ionization chamber to the pre-rod of the quadrupole mass filter, wherein: a potential of an exit side electrode of the ion optical system is lower than a potential of the ionization chamber and a potential of the pre-rod of the quadrupole mass filter; and there is no structure that has a higher potential than the exit side electrode and decelerates the ions between the exit side electrode and the pre-rod.

The quadrupole mass spectrometer according to the 2nd aspect is in the quadrupole mass spectrometer according to the 1st aspect, it is preferable that: a distance from a central axis of the ion optical system and the quadrupole mass filter to the exit side electrode is equal to or less than half a distance from the central axis to the pre-rod; and a distance from the exit side electrode to the pre-rod is equal to or less than half a length of the pre-rod in the central axis direction.

The quadrupole mass spectrometer according to the 3rd aspect is in the quadrupole mass spectrometer according to the 2nd aspect, it is preferable that the quadrupole mass spectrometer further comprises: a partition wall that separates the ion optical system and the quadrupole mass filter and in which an ion passage hole is formed on the central axis of the ion optical system; wherein: at least a part of the exit side electrode of the ion optical system is arranged inside the ion passage hole so as to surround the central axis of the ion optical system without contacting the partition wall.

The quadrupole mass spectrometer according to the 4th aspect is in the quadrupole mass spectrometer according to any one of the 1st to 3rd aspect, it is preferable that the ionization chamber is a gas sample ionization chamber that ionizes analysis target carried by carrier gas.

The quadrupole mass spectrometer according to the 5th aspect is in the quadrupole mass spectrometer according to any one of the 1st to 3rd aspect, it is preferable that: the ionization chamber is a CID cell; the ion optical system guides product ions generated in the CID cell to the pre-rod of the quadrupole mass filter; and the quadrupole mass spectrometer further comprises: a second ionization chamber that generates precursor ions to be supplied to the CID cell; a second quadrupole mass filter that selects the precursor ions; and a second ion optical system that guides the precursor ions generated in the second ionization chamber to the second quadrupole mass filter.

The quadrupole mass spectrometer according to the 6th aspect is in the quadrupole mass spectrometer according to the 5th aspect, it is preferable that: the second ionization chamber is a liquid sample ionization chamber that ionizes analysis target carried by carrier liquid.

The quadrupole mass spectrometer according to the 7th aspect is in the quadrupole mass spectrometer according to the 5th aspect, it is preferable that: the second quadrupole mass filter has a pre-rod; and a potential of an exit side electrode of the second ion optical system is lower than a potential of the second ionization chamber and a potential of the pre-rod of the second quadrupole mass filter.

The quadrupole mass spectrometer according to the 8th aspect is in the quadrupole mass spectrometer according to the 7th aspect, it is preferable that: the second ionization chamber is a gas sample ionization chamber that ionizes analysis target carried by carrier gas.

Advantageous Effects of Invention

According to the present invention, it is possible to improve the incident efficiency of ions to the quadrupole mass filter and realize a highly sensitive and highly accurate quadrupole mass spectrometer.

DESCRIPTION OF EMBODIMENTS

In the present specification, the term "potential" means an electrical potential that acts on a charged ion. The term "potential" is synonymous with an electric potential for a positively charged ion, and represents the amount of sign opposite to an electric potential for a negatively charged ion.

Quadrupole Mass Spectrometer according to First Embodiment

Figure 1A:
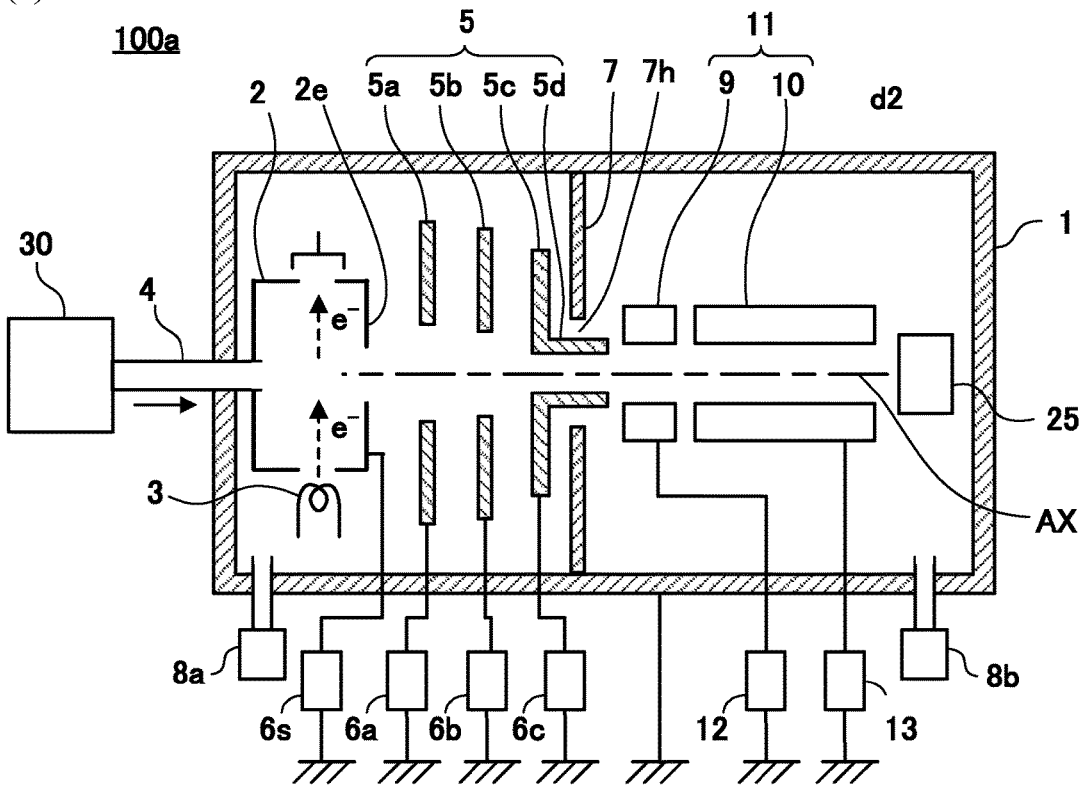
FIGS. 1(*a*)-1(*c*) are schematic views showing a configuration of a quadrupole mass spectrometer according to the first embodiment, FIG. 1(*a*) is a side sectional view of the quadrupole mass spectrometer, FIG. 1(*b*) is a graph showing a potential on the central axis AX in the device shown in FIG. 1(*a*), and FIG. 1(*c*) is an enlarged view of a part of the device shown in FIG. 1(*a*).
Figure 1B:
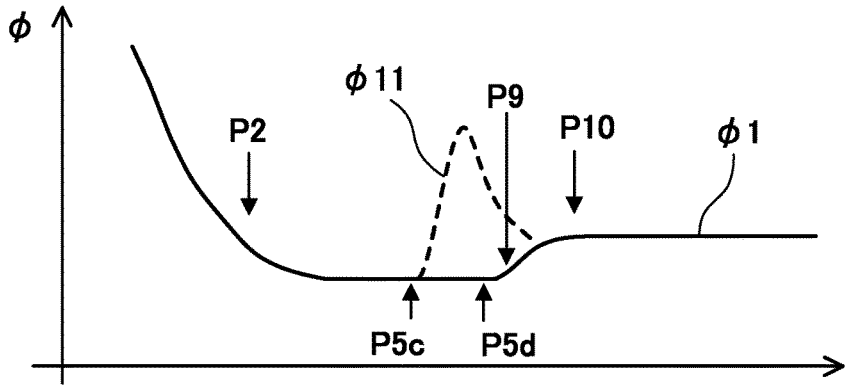
Figure 1C:
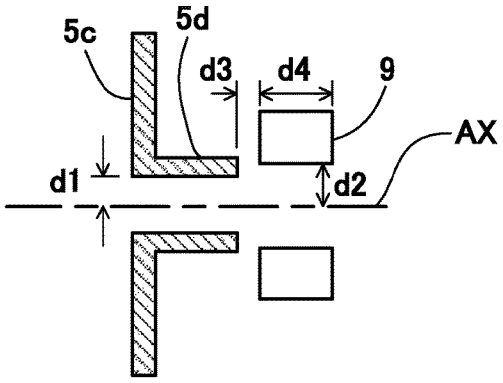

FIGS. 1(*a*)-1(*c*) are views showing a configuration of a quadrupole mass spectrometer 100 according to the first embodiment. FIG. 1(*a*) is a side sectional view of the quadrupole mass spectrometer 100, FIG. 1(*b*) is a graph showing a potential on the central axis AX in the quadrupole mass spectrometer 100, and FIG. 1(*c*) is an enlarged view of a part of the device shown in FIG. 1(*a*).

In the quadrupole mass spectrometer 100, an ionization chamber 2, an ion optical system 5, a partition wall 7, a quadrupole mass filter 11, and an ion detector 25 are provided inside a vacuum container 1 along the central axis AX.

A gas chromatograph device 30 is provided as a precedent stage of the quadrupole mass spectrometer 100, and a sample gas flowing out of the gas chromatograph device 30 is supplied into the ionization chamber 2 via a connecting pipe 4. The ionization chamber 2 is an example of a gas sample ionization apparatus that ionizes an analysis target transferred by a carrier gas by an electron impact method. Thermo electrons generated at the filament 3 are accelerated and come into contact with sample molecules (or atoms) having introduced into the ionization chamber 2, so that the sample molecules are ionized.

Generated ions are drawn out from the ionization chamber 2 by the potential difference applied between the ionization chamber 2 and the ion optical system 5 and enter the ion optical system 5. Then, the ions are converged by the ion optical system 5 and enter a pre-rod 9.

As an example, the ion optical system 5 is an electrostatic lens composed of three electrodes of an entrance side electrode 5*a*, a middle stage electrode 5*b*, and an exit side electrode 5*c*.

The quadrupole mass filter 11 includes the pre-rod 9 and a main rod 10 each having four rod electrodes. To the pre-rod 9, an AC voltage is applied from a power supply 12 and to the main rod 10, voltage superimposing of a DC voltage and an AC voltage is applied from a power supply 13. An ion axis of the quadrupole mass filter 11 coincides with an optical axis of the ion optical system 5, and both axes are collectively referred to as the central axis AX.

The partition wall 7 is a partition wall inside the vacuum container 1, that separates a space in which the ion optical systems 5 is arranged from a space in which the quadrupole mass filter 11 is arranged. Each of these spaces requires a different degree of vacuum. At an area corresponding to the central axis AX of the partition wall 7 and the vicinity thereof, an ion passage hole 7*h* for passing ions is formed.

In the first embodiment, a protrusion portion 5*d* substantially cylindrical, which is a portion of the exit side electrode 5*c* of the ion optical system 5 near the central axis AX, is arranged inside the ion passage hole 7*h* surrounding the central axis AX so as not to contact with the partition wall 7.

Both spaces in the vacuum container 1 separated by the partition wall 7 are respectively evacuated by vacuum pumps 8*a* and 8*b*.

Different voltages are applied to electrodes 5*a* to 5*c* of the ion optical system 5 respectively from power supplies 6*a* to 6*c*. In general, the voltage of the vacuum container 1 is kept at the ground potential so that it can be easily handled. Therefore, the voltage of the partition wall 7 attached to the inner wall of the vacuum container 1 is also kept at the ground potential.

Also, a predetermined voltage is applied to the exit side 2*e* of the ionization chamber 2 by a power supply 6*s*.

FIG. 1(*b*) is a graph showing a potential φ1 on the central axis AX in the quadrupole mass spectrometer 100. That is, the potential φ1 formed on the central axis AX by the voltage applied to the electrodes 5*a* to 5*c* of the ion optical system 5 and the voltage applied to the pre-rod 9 is shown.

As described above, in a case where the analysis target is cation, the potential φ1 is synonymous with a potential, and in a case where the analysis target is anion, the potential φ1 has the opposite sign to a potential.

In the first embodiment, a potential of the exit side electrode 5*c* of the ion optical system 5 is set lower than a potentials of the ionization chamber 2, and a potential of the pre-rod 9 of the quadrupole mass filter 11. Thereby, the potential φ1 on the central axis AX decreases from an outlet (position P2) of the ionization chamber 2 toward an entrance side end portion (position P5*c*) of the exit side electrode 5*c* of the ion optical system 5. On the other hand, since the protrusion portion 5*d* of the exit side electrode 5*c* surrounds the central axis AX, between the entrance side end portion (position P5*c*) of the exit side electrode 5*c* and an exit side end portion (position P5*d*) of the protrusion portion 5*d*, the potential φ1 is in substantially constant value. After an entrance surface (position P9) of the pre-rod 9, the potential φ1 on the central axis AX rises due to the voltage applied to the pre-rod 9. Then, after the incident surface (position P10) of the main rod 10, the potential φ1 becomes almost constant.

Therefore, the ions exiting the ionization chamber 2 are accelerated according to the inclination of the potential φ1 in the path to the exit side electrode 5*c* (position P5*c*) of the ion optical system 5, and then pass through inside the protrusion portion 5*d* without being decelerated. Then, the ions enter the pre-rod 9 and are decelerated due to the voltage applied to the pre-rod 9.

In the first embodiment, the ions are accelerated by the ion optical system 5 and then enter the pre-rod 9 with almost no deceleration. Therefore, the velocity of the ion beams at the time of entering the pre-rod 9 can be increased, and thus the divergence angles of the ion beams can be reduced. Thereby, emittances of the ion beams at the time of entering the pre-rod 9 can be brought close to acceptance range of the pre-rod 9. As a result, in the first embodiment, the ion beams can be efficiently introduced into the pre-rod 9.

A potential φ11 shown by the broken line in FIG. 1(*b*) shows the potential on the central axis AX in a conventional commonly used ion optical system for comparison. In the conventional commonly used ion optical system, it was common that the partition wall 7 itself, which has the ion passage hole 7*h* for shielding a space in which the ion optical system 5 is arranged and a space in which the quadrupole mass filter 11 is arranged, is used as an exit side electrode of the ion optical system 5.

However, in such a configuration, since the partition wall 7 is maintained at the ground potential as described above, as can be seen from the potential φ11, a large potential barrier is generated by the partition wall 7 immediately before the pre-rod 9. Therefore, the ion beams are greatly decelerated by the barrier (the potential φ11) formed by the partition wall 7, and enter the pre-rod 9 with a large divergence angles. As a result, most of the emittances of the ion beams that have passed through the conventional ion optical system do not fall within the acceptance range of the pre-rod 9, and the proportion of ions that cannot enter the pre-rod 9 becomes high.

In the first embodiment, as described above, the protrusion portion 5*d* of cylindrical, which is a part of the exit side electrode 5*c* of the ion optical system 5, surrounds the central axis AX and is arranged inside the ion passage hole 7*h* which is formed inside the partition wall 7 so as not to contact with the partition wall 7. Therefore, since the electric field formed by the partition wall 7 which is the ground potential is shielded by the protrusion portion 5*d*, the potential on the central axis AX and its vicinity is not adversely affected. Thereby, the ions are not decelerated between the exit side electrode 5*c* and the pre-rod 9. Further, between the exit side electrode 5*c* and the pre-rod 9, there is no structure other than the partition wall 7 having a higher potential than the exit side electrode 5*c*, which decelerates ions. That is, there is no structure having a higher potential than that of the exit side electrode 5*c* which forms a potential such for decelerating ions on the path between the exit side electrode 5*c* and the pre-rod 9. Therefore, in the first embodiment, the ion beams can enter the pre-rod 9 while maintaining preferable emittances, and the ion beams can be efficiently introduced into the pre-rod 9.

FIG. 1(*c*) shows an enlarged view of a portion of the exit side electrode 5*c* and the pre-rod 9 in the quadrupole mass spectrometer 100 shown in FIG. 1(*a*).

In order to decelerate inside the pre-rod 9 without decelerating the ions to the entrance surface (position P9) of the pre-rod 9, it is preferable to satisfy the following condition in the positional relationship between the exit side electrode 5*c* of the ion optical system 5, the pre-rod 9, and the central axis AX.

That is, the distance d1 from the central axis AX to the exit side electrode 5*c* (the protrusion portion 5*d*) in the direction perpendicular to the central axis AX is preferably half or less than the distance d2 from the central axis AX to the pre-rod 9. Further, the distance d3 from the exit side electrode 5*c* (the protrusion portion 5*d*) to the pre-rod 9 in the central axis AX direction is preferably half or less of the length d4 of the pre-rod 9 in the central axis AX direction.

Here, the distance means the distance from the ends of one thing to the end of another. For example, the distance d3 from the exit side electrode 5*c* (the protrusion portion 5*d*) to the pre-rod 9 is the distance from the right end of the protrusion portion 5*d* to the left end of the pre-rod 9. Further, since the protrusion portion 5*d* is a substantially cylindrical member arranged around the central axis AX as described above, the distance d1 from the central axis AX to the exit side electrode 5C (the projection portion 5*d*) in the direction perpendicular to the central axis AX is equal to half of the inner diameter of the protrusion portion 5*d*.

By satisfying the above conditions of the positional relationship, the potential φ1 can be made substantially equal at the entrance surface (position P9) of the pre-rod 9 and at the exit end of the protrusion portion 5*d* (position P5*d*). As a result, the ions can enter the pre-rod 9 without decelerating until the entrance surface of the pre-rod 9, and it is possible to introduce the ions into the pre-rod 9 more efficiently.

Variation of Quadrupole Mass Spectrometer

Figure 2A:
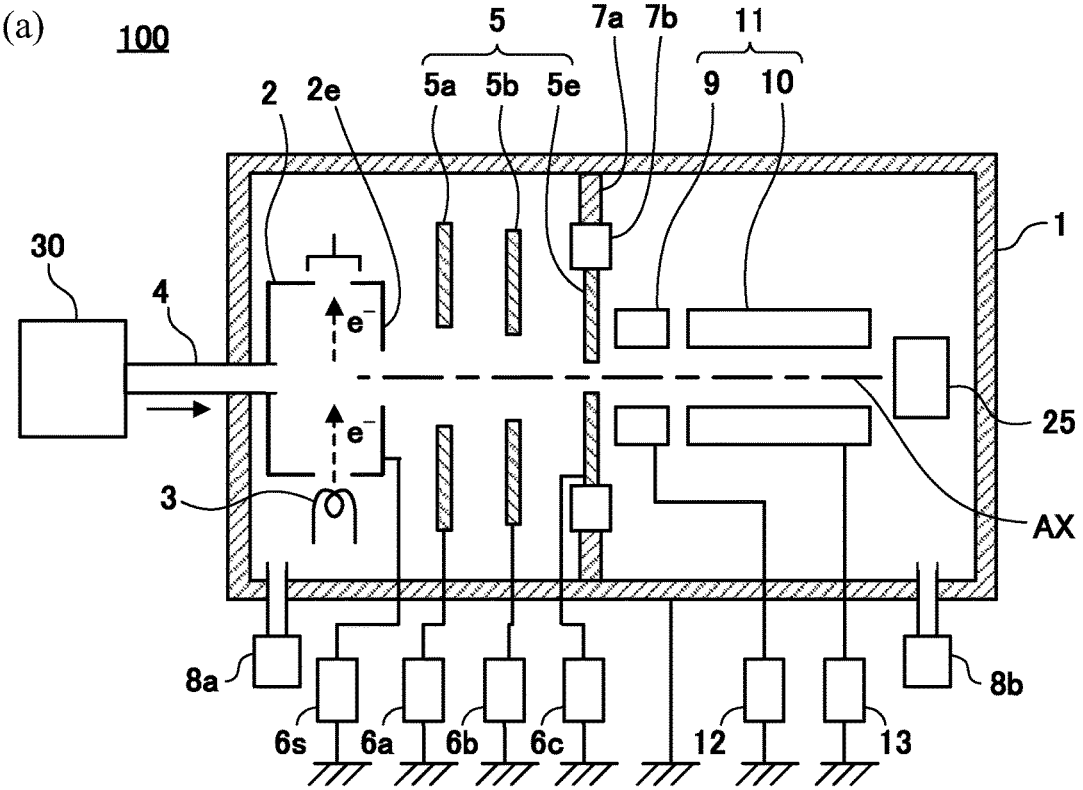
FIGS. 2(*a*)-2(*c*) are schematic views showing a configuration of a quadrupole mass spectrometer according to the variation, FIG. 2(*a*) is a side sectional view of the quadrupole mass spectrometer, FIG. 2(*b*) is a graph showing a potential on the central axis AX in the device shown in FIG. 2(*a*), and FIG. 2(*c*) is an enlarged view of a part of the device shown in FIG. 2(*a*).
Figure 2B:
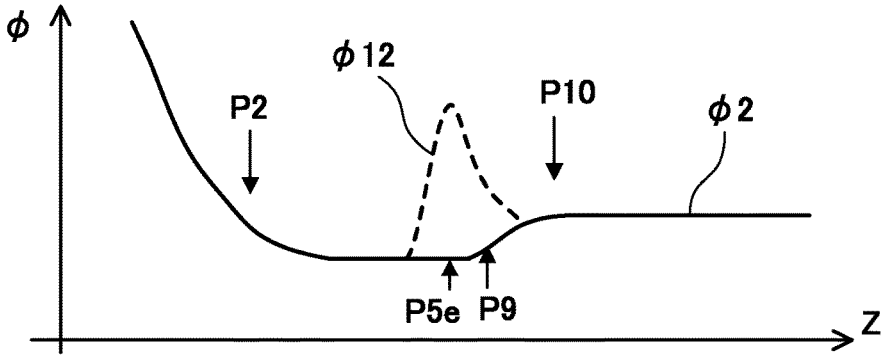
Figure 2C:
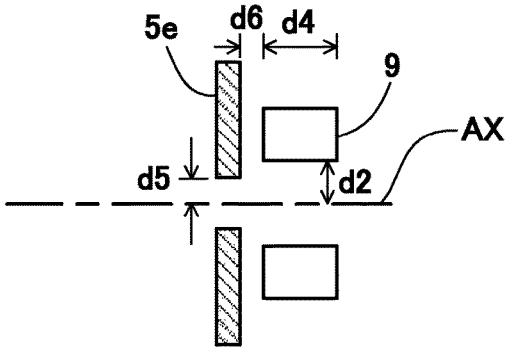

FIG. 2(*a*) is a schematic view showing a configuration of a quadrupole mass spectrometer 100*a* according to a variation. The configuration of the quadrupole mass spectrometer 100*a* according to the variation is mostly common to the quadrupole mass spectrometer 100 according to the first embodiment described above. Therefore, the same reference signs are given to the common parts, and the description thereof will be omitted as appropriate.

In the mass spectrometer 100*a* of the variation, in a vacuum container 1, an exit side electrode 5*e* of an ion optical system 5 together with a partition wall 7*a*, forms a part of a partition that divides a space in which the ion optical system 5 is arranged and a space in which a quadrupole mass filter 11 is arranged. In such a case, as described above, since the vacuum container 1 is commonly to be set to the ground potential, the partition wall 7*a* is set to the ground potential. Thus, in the present variation, an airtight insulating member 7*b* made of ceramic or the like is provided between the exit side electrode 5*e* of the ion optical system 5 and the partition wall 7*a* to electrically insulate the exit side electrode 5*e* and the partition wall 7*a*. Further, a potential, lower than a potential applied from a power supply 6*s* to an exit of an ionization chamber 2 and a potential from a power supply 12 to a pre-rod 9, is applied from a power supply 6*c* to the exit side electrode 5*e*. There is no structure having a higher potential than that of the exit side electrode 5*e* which forms a potential such for decelerating ions on the path between the exit side electrode 5*e* and the pre-rod 9.

FIG. 2(*b*) is a graph showing a potential φ2 on the central axis AX in the quadrupole mass spectrometer 100*a* according to the variation. Also in the present variation, the potential φ2 on the central axis AX decreases from an outlet (position P2) of the ionization chamber 2 toward the exit side electrode 5*e* (position P5*e*) of the ion optical system 5. The potential φ2 on the central axis AX rises due to the voltage applied to the pre-rod 9 after an entrance surface (position P9) of the pre-rod 9. Then, after an entrance surface (position P10) of a main rod 10, the potential φ2 becomes almost constant.

Therefore, the ions exiting the ionization chamber 2 are accelerated according to the inclination of the potential φ2 in the path to the exit side electrode 5*e* (position P5*e*) of the ion optical system 5, then enter the pre-rod 9 with almost no deceleration, and further then the ions are decelerated due to the voltage applied to the pre-rod 9.

Thereby, since emittances of the ion beams at the time of entering the pre-rod 9 can be brought close to acceptance range of the pre-rod 9, the ion beams can be efficiently introduced into the pre-rod 9 in the variation.

The potential φ12 shown by the broken line in FIG. 2(*b*) shows, for comparison, the potential on the central axis AX in which the insulating member 7*b* is not provided as in the conventional case and therefore the exit side electrode 5*e* is in the ground potential. In such a configuration, a large potential barrier is generated by the exit side electrode 5*e*, which is kept at the ground potential, immediately before the pre-rod 9. Then, the ion beams are greatly decelerated at the exit side electrode 5*e* and enter the pre-rod 9 with a large divergence angle. As a result, most of the emittances of the ion beams that have passed through the conventional ion optical system do not fall within the acceptance range of the pre-rod 9, and the proportion of ions that cannot enter the pre-rod 9 becomes high.

FIG. 2(*c*) shows an enlarged view of a portion of the exit side electrode 5*e* and the pre-rod 9 in the quadrupole mass spectrometer 100*a* according to the variation shown in FIG. 2(*a*).

In order to decelerate the ions inside the pre-rod 9 without decelerating the ions to the entrance surface (position P9) of the pre-rod 9, it is preferable to satisfy the following condition in the positional relationship between the exit side electrode 5*e* of the ion optical system 5, the pre-rod 9, and the central axis AX.

That is, the distance d5 from the central axis AX to the exit side electrode 5*e* in the direction perpendicular to the central axis AX is preferably half or less of the distance d2 from the central axis AX to the pre-rod 9. Further, the distance d6 from the exit side electrode 5*e* to the pre-rod 9 in the central axis AX direction is preferably half or less of the length d4 of the pre-rod 9 in the central axis AX direction.

By satisfying the above conditions of the positional relationship, the potential φ2 can be made substantially equal at the entrance surface (position P9) of the pre-rod 9 and at the exit end electrode 5*e* (position P5*e*). As a result, the ions can enter the pre-rod 9 without decelerating until the entrance surface of the pre-rod 9, and the ions can be introduced into the pre-rod 9 more efficiently.

In the quadrupole mass spectrometers 100 and 100*a* which are according to the first embodiment and the variation, described above, the gas sample ionization apparatus is not limited to the ionization chamber 2 adopting the above-mentioned electron impact method. It may be an apparatus based on a chemical ionization method.

Further, as the apparatus for ionizing the sample, an apparatus for ionizing a liquid sample such as ESI, APCI, APCI, etc. can also be used instead of the ionization chamber 2 for ionizing the gas sample.

Advantageous Effects of First Embodiment and Variation

According to the above-mentioned first embodiment and variation, the following advantageous effects can be obtained.

(1) Each of the quadrupole mass spectrometers according to the above-mentioned first embodiment and variation comprises: the quadrupole mass filter 11 including the pre-rod 9; the ionization chamber 2; and the ion optical system 5 that guides ions generated in the ionization chamber 2 to the pre-rod 9 of the quadrupole mass filter 11, wherein: a potential of the exit side electrode 5*c* or 5*e* of the ion optical system 5 is lower than a potential of the ionization chamber 2 and a potential of the pre-rod 9 of the quadrupole mass filter 11; and there is no structure that has a higher potential than the exit side electrode 5*c* or 5*e* and decelerates the ions between the exit side electrode 5*c* or 5*e* and the pre-rod 9.

With this configuration, the ions are accelerated by the ion optical system 5 and then enter the pre-rod 9 with almost no deceleration. That is, the velocity of the ion beams enter the pre-rod 9 can be increased, and the divergence angles of the ion beams can be reduced. Thereby, emittances of the ion beams at the time of entering the pre-rod 9 can be brought close to acceptance range of the pre-rod 9, and the ions can be efficiently introduced into the pre-rod 9. As a result, the incident efficiency of ions to the quadrupole mass filter 11 can be improved, and the quadrupole mass spectrometers 100 and 100*a* with high sensitivity and high accuracy can be realized.

(2) Moreover, in the quadrupole mass spectrometer, by configuring: the distance d1 or d4 from a central axis AX of the ion optical system 5 and the quadrupole mass filter 11 to the exit side electrode 5*c* or 5*e* is equal to or less than half the distance d2 from the central axis AX to the pre-rod 9; and the distance d3 or d5 from the exit side electrode 5*c* or 5*e* to the pre-rod 9 is equal to or less than half the length d4 of the pre-rod 9 in the central axis AX direction, the ions can enter the pre-rod 9 without decelerating until the entrance surface of the pre-rod 9, and the ions can be introduced into the pre-rod 9 more efficiently.

(3) Further, by further comprising the quadrupole mass spectrometer: the partition wall 7 that separates the ion optical system 5 and the quadrupole mass filter 11 and in which the ion passage hole 7*h* is formed on the central axis AX of the ion optical system 5; wherein: at least a part of the exit side electrode 5*c* (the protrusion portion 5*d*) of the ion optical system 5 is arranged inside the ion passage hole 7*h* so as to surround the central axis AX of the ion optical system 5 without contacting the partition wall 7, the influence of the ground potential applied to the partition wall 7 to the central axis AX is shielded by the protrusion portion 5*d*. Therefore, since it is not necessary to provide an insulating mechanism to the partition wall, cost reduction can be realized to the partition wall 7 and the entire device.

(4) Yet further, by configuring the ionization chamber 2 as the gas sample ionization chamber that ionizes analysis target carried by carrier gas, the quadrupole mass spectrometer that is efficient with respect to the gas sample supplied from the gas chromatograph device 30 can be realized.

Quadrupole Mass Spectrometer According to Second Embodiment

Figure 3:
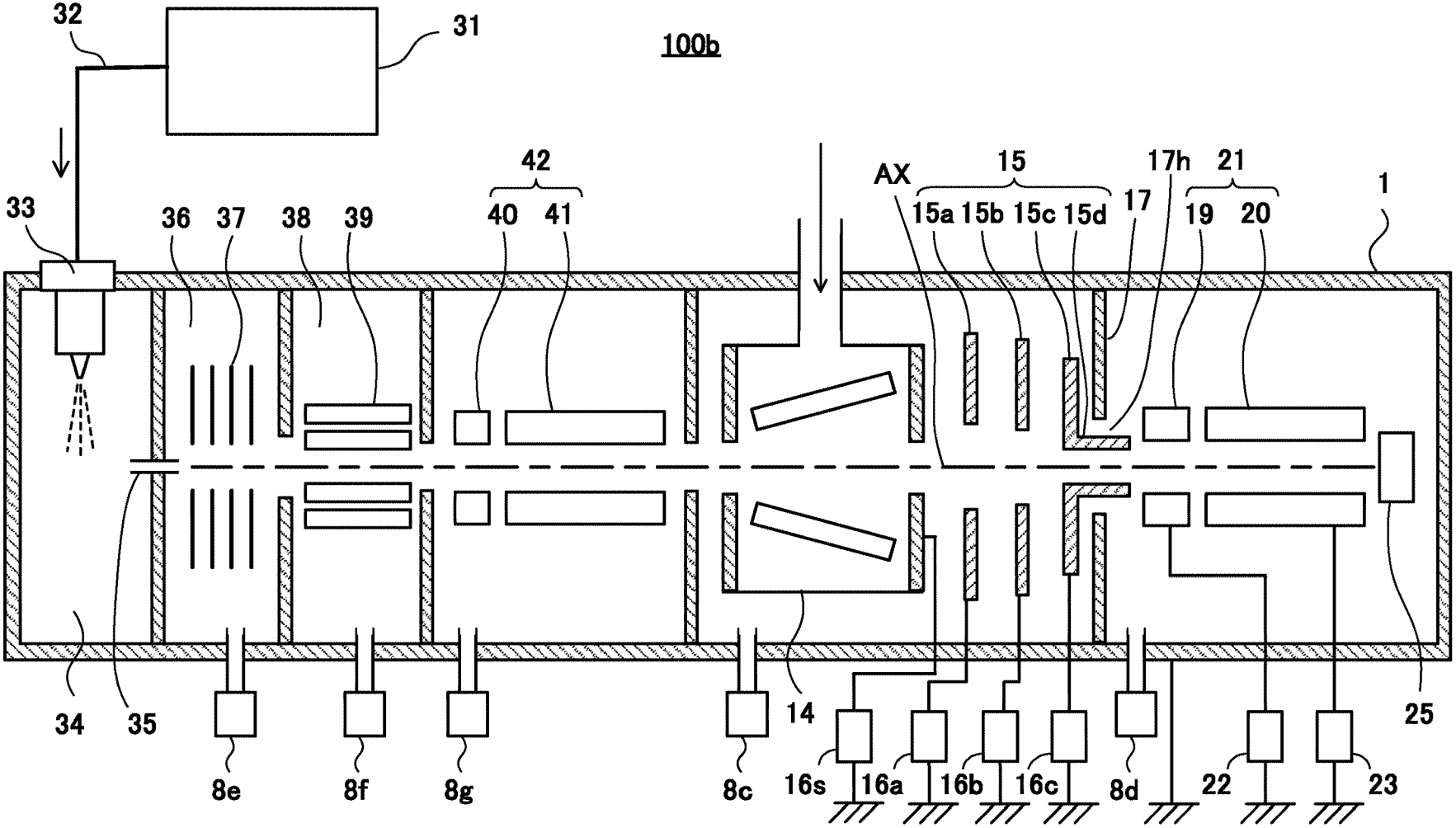
FIG. 3 is a schematic view showing the configuration of the quadrupole mass spectrometer according to the second embodiment.

FIG. 3 is a schematic view showing a configuration of a quadrupole mass spectrometer 100*b* according to the second embodiment.

Since the configuration of the quadrupole mass spectrometer 100*b* according to the second embodiment is common in many parts to the quadrupole mass spectrometer 100 according to the first embodiment described above, the same reference signs are given to the common parts, and the description thereof will be omitted as appropriate.

In the quadrupole mass spectrometer 100*b* according to the second embodiment, the configurations of an ion optical system 15 and a quadrupole mass filter 21 respectively are the same as the ion optical system 5 and the quadrupole mass filter 11 of the quadrupole mass spectrometer 100 according to the first embodiment described above. Further, the configurations of power supplies 16*a* to 16*c* and power supplies 22 and 23 that supply voltages to the ion optical system 15 and the quadrupole mass filter 21, respectively, are also the same as the power supplies 6*a* to 6*c* and the power supplies 12 and 13 of the quadrupole mass spectrometer 100 according to the first embodiment described above.

A partition wall 17 is, inside a vacuum container 1, a partition wall that separates the spaces to which different vacuum degrees are required, one of which is a space in which the ion optical systems 15 is arranged and the other of which is a space in which the quadrupole mass filter 21 is arranged. Similar to the partition wall 7 of the first embodiment described above, at an area corresponding to, the central axis AX of the partition wall 17 and the vicinity thereof, an ion passage hole 17*h* for passing ions is formed. Further, similar to the first embodiment described above, a substantially cylindrical protrusion portion 15*d*, which is the portion within an exit side electrode 15*c* of the ion optical system 15 near the central axis AX, is arranged inside the ion passage hole 17*h* surrounding the central axis AX so as not to contact with the partition wall 17.

In the quadrupole mass spectrometer 100*b* according to the second embodiment, a quadrupole mass filter 42 and a CID (collision-induced dissociation) cell 14 are arranged, as the preceding stage, on the upstream side of the ion optical system 15, and that is, it is so-called triple quadrupole mass spectrometer. Therefore, the ions carried by the ion optical system 15 are mainly product ions generated in the CID cell 14.

Liquid sample supplied from a liquid chromatograph device 31 is guided to an electrospray 33 by an introduction pipe 32. The electrospray 33 sprays the liquid sample into a liquid sample ionization chamber 34 together with a nebulizer gas such as nitrogen while applying an electric charge to the liquid sample. Sprayed liquid sample repeatedly evaporates and splits in the liquid sample ionization chamber 34 to become ions of sample molecule.

It is noted that the method of ionizing the analysis target in the liquid sample ionization chamber 34 is not limited to the ESI method (Electrospray Ionization Method) using the above-mentioned electrospray 33. For example, the liquid sample may be ionized by Atmospheric Pressure Chemical Ionization (APCI) or Atmospheric Pressure Photoionization source (APCI).

It is to be noted that, in the second embodiment, the CID cell 14 is also referred to as a first ionization chamber, and the liquid sample ionization chamber 34 is also referred to as a second ionization chamber. Further, the quadrupole mass filter 11 is also referred to as a first quadrupole mass filter, and the quadrupole mass filter 42 of the preceding stage is also referred to as a second quadrupole mass filter.

The ions generated in the liquid sample ionization chamber 34 enter a first intermediate vacuum chamber 36 through a small diameter heating capillary 35. Then, the ions are guided by an ion guide 37 provided in the first intermediate vacuum chamber 36 and further enter a second intermediate vacuum chamber 38. The second intermediate vacuum chamber 38 is also provided with an ion guide 39, and the ions are guided by the ion guide 39 and enter the quadrupole mass filter 42 of the preceding stage including a pre-rod 40 and a main rod 41.

The ions (precursor ions) that have passed through the quadrupole mass filter 42 of the preceding stage enter the CID cell 14 and collide with the inert gas (collision gas) such as argon or nitrogen supplied to the CID cell 14. Upon collision, the precursor ions are cleaved at weak chemical bond portions to produce product ions. The product ions generated in the CID cell 14 are drawn out from the CID cell 14 due to the potential difference applied between the CID cell 14 and the ion optical system 15 and enter the ion optical system 15. The product ions are converged by the ion optical system 15 and enter a pre-rod 19 of the quadrupole mass filter 21. Then, only ions having a predetermined mass-to-charge ratio pass through a main rod 20 of the quadrupole mass filter 21 and are detected by an ion detector 25.

The optical axes of the ion guides 37 and 39, and the ion axis of the quadrupole mass filter 42 of the preceding stage coincide with the central axis AX, which is the optical axis of the ion optical system 5 and the ion axis of the quadrupole mass filter 11.

In the vacuum container 1, a space in which the first intermediate vacuum chamber 36, a space in which the second intermediate vacuum chamber 38, and a space in which the quadrupole mass filter 42 of the preceding stage are installed are depressurized by vacuum pumps 8*e*, 8*f*, and 8*g*, respectively.

Similar to the first embodiment described above, a potential, lower than a potential applied to the pre-rod 19 of the quadrupole mass filter 21 and a potential applied from a power supply 16*s* to an exit side of the CDI cell 14, is applied to the exit side electrode 15*c* of the ion optical system 15. Thus, also in the second embodiment, the ions exiting the CDI cell 14 are accelerated by the ion optical system 15 and then enter the pre-rod 19 with almost no deceleration. Therefore, the velocity of the ion beams at the time of entering the pre-rod 19 can be increased, and thus the divergence angles of the ion beams can be reduced. As a result, emittances of the ion beams at the time of entering the pre-rod 19 can be brought close to acceptance range of the pre-rod 19. Thereby, also in the second embodiment, the ion beams can be efficiently introduced into the pre-rod 19.

Quadrupole Mass Spectrometer According to Third Embodiment

Figure 4:
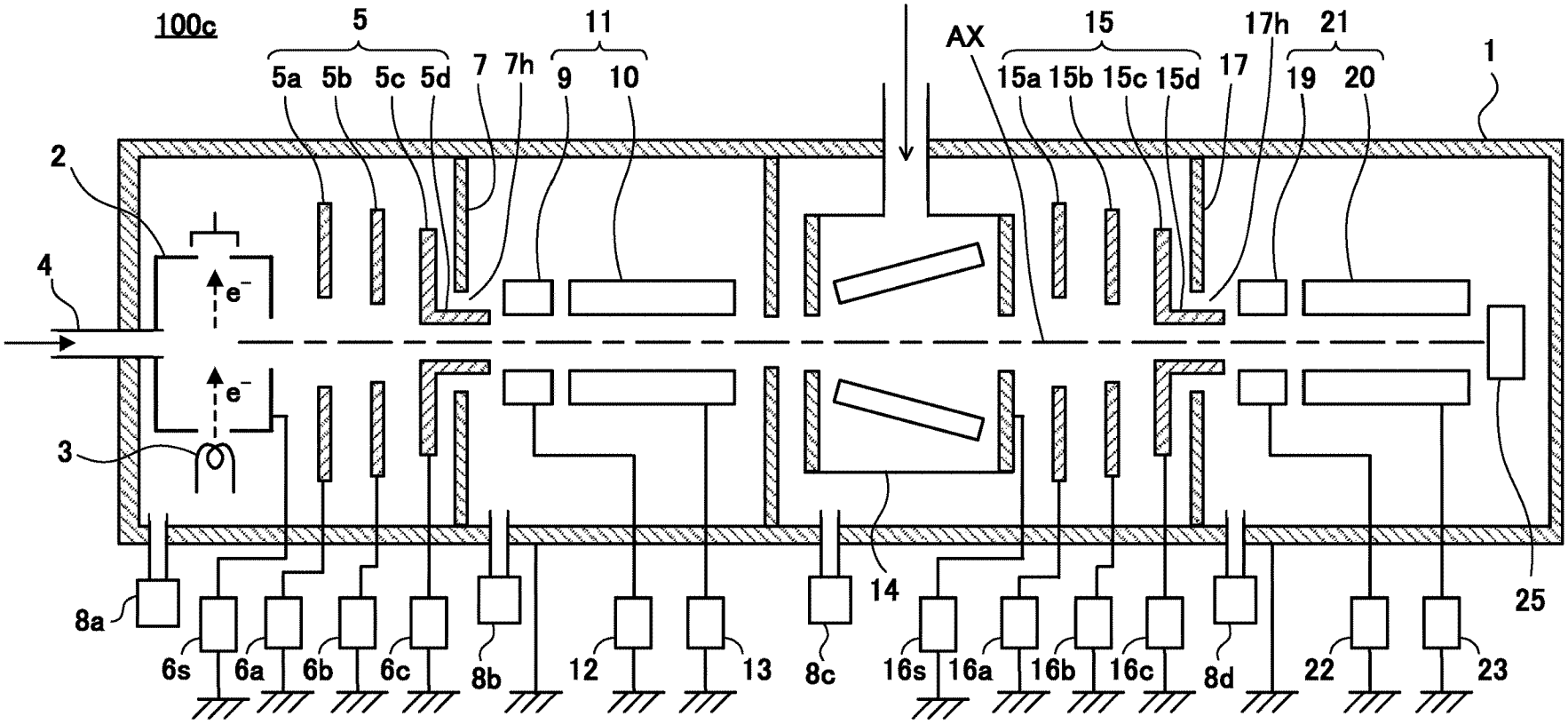
FIG. 4 is a schematic view showing the configuration of the quadrupole mass spectrometer according to the third embodiment.

FIG. 4 is a schematic view showing a configuration of a quadrupole mass spectrometer 100*c* according to the third embodiment.

Since the configuration of the quadrupole mass spectrometer 100*c* according to the third embodiment is common in many parts to the quadrupole mass spectrometer 100 according to the first embodiment or the quadrupole mass spectrometer 100*b* according to the second embodiment, described above, the same reference signs are given to the common parts, and the description thereof will be omitted as appropriate.

In the quadrupole mass spectrometer 100*c* according to the third embodiment, the configurations of an ionization chamber 2, an ion optical system 5, a partition wall 7, a quadrupole mass filter 11, power supplies 6*a* to 6*s*, power supplies 12 and 13, and vacuum pumps 8*a* and 8*b* respectively are the same as those of the quadrupole mass spectrometer 100 according to the first embodiment described above. Further, the configurations of a CDI cell 14, an ion optical system 15, a partition wall 17, a quadrupole mass filter 21, power supplies 16*a* to 16*s*, power supplies 22 and 23, and vacuum pumps 8*c* and 8*d* respectively are the same as those of the quadrupole mass spectrometer 100*b* according to the second embodiment described above.

It is to be noted, FIG. 4 omits the illustration of the gas chromatograph device 30.

The quadrupole mass spectrometer 100*c* according to the third embodiment is a so-called triple quadrupole mass spectrometer. Precursor ions generated in the ionization chamber 2 are guided to the quadrupole mass filter 11 by the ion optical system 5. The ions having a specific mass-to-charge ratio that have passed through the quadrupole mass filter 11 enter the CID cell 14, and in the CID cell 14, product ions are generated. The product ions generated in the CID cell 14 are guided to the quadrupole mass filter 21 by the ion optical system 15, and only the ions having a specific mass-to-charge ratio pass through the quadrupole mass filter 21 and are detected by an ion detector 25.

It is to be noted that, in the third embodiment, the CID cell 14 is also referred to as a first ionization chamber, and the ionization chamber 2 is also referred to as a second ionization chamber. Moreover, the quadrupole mass filter 21 is also referred to as a first quadrupole mass filter, and the quadrupole mass filter 11 is also referred to as a second quadrupole mass filter. Furthermore, the ion optical system 15 is also referred to as a first ion optical system and the ion optical system 5 is also referred to as a second ion optical system.

It is to be noted, also in the second and third embodiments described above, the ion optical systems 5 and 15 may be configured that the exit side electrode 5*e* is held to the partition wall 7*a* through the insulating member 7*b*, similarly to the ion optical system 5 of the variation shown in FIGS. 2(*a*)-2(*c*).

Further, in any of the embodiments and the variation, the ion optical systems 5 and 15 are not limited to the electrostatic lens composed of three electrodes, and may be an ion optical system including more electrodes.

Advantageous Effects of Second Embodiment and Third Embodiment

According to the above-mentioned second embodiment and the third embodiment, the following advantageous effects can be obtained.

(5) In each of the quadrupole mass spectrometers according to the second embodiment and the third embodiment, the first ionization chamber of the quadrupole mass spectrometers of the first embodiment is the CID cell 14 and the ion optical system 15 guides product ions generated in the CID cell 14 to the pre-rod 19 of the quadrupole mass filter 21. And each of the quadrupole mass spectrometers according to the second embodiment and the third embodiment further comprises: the second ionization chamber (the liquid sample ionization chamber 34, the ionization chamber 2) that generates precursor ions to be supplied to the CID cell 14; the second quadrupole mass filter (the quadrupole mass filter 42 of the preceding stage, the quadrupole mass filter 11) that selects the precursor ions; and the second ion optical system (the ion guide 37, the ion guide 38, the ion optical system 5) that guides the precursor ions generated in the second ionization chamber to the second quadrupole mass filter. With this configuration, the product ions generated in the CID cell 14 can be efficiently introduced into the quadrupole mass filter 21. As a result, the incident efficiency of ions to the quadrupole mass filter 21 can be improved, and high-sensitivity and high-precision quadrupole mass spectrometers 100*b* and 100*c* can be realized.

(6) Moreover, in each of the quadrupole mass spectrometers according to the second embodiment and the third embodiment, by setting the second ionization chamber as the liquid sample ionization chamber 34 that ionizes analysis target carried by carrier liquid, it is possible to realize a quadrupole mass spectrometer capable of efficiently analyzing the liquid sample supplied from the liquid chromatograph device 31.

(7) Furthermore, in each of the quadrupole mass spectrometers according to the second embodiment and the third embodiment, by configuring: the second quadrupole mass filter 11 has the pre-rod 9; and a potential of the exit side electrode 5*c* of the second ion optical system (the ion optical system 5) is lower than a potential of the second ionization chamber (the ionization chamber 2) and a potential of the pre-rod 9 of the second quadrupole mass filter (the quadrupole mass filter 11), it is possible to improve the incident efficiency of ions in both the quadrupole mass filter 11 on the preceding stage side and the quadrupole mass filter 21 on the rear stage side of the triple quadrupole mass spectrometer.

The present invention is not limited to the contents of the above embodiments. Other aspects conceivable within the scope of the technical idea of the present invention are also included within the scope of the present invention.

REFERENCE SIGNS LIST

100, 100*a-c* . . . Quadrupole Mass Spectrometer, 1 . . . Vacuum Container,

2 . . . Gas Sample Ionization Chamber (Ionization Chamber), 3 . . . Filament,

4 . . . Connecting Pipe, 5, 15 . . . Ion optical system,

6*a*-6*s*, 16*a*-16*s* . . . Power Supply, 8*a*-8*g* . . . Vacuum Pump,

11, 21 . . . Quadrupole Mass Filter, 9, 19 . . . Pre-rod, 10, 20 . . . Main Rod,

25 . . . Ion Detector, 14 . . . CID Cell, 30 . . . Gas Chromatograph Device,

31 . . . Liquid Chromatograph Device, 33 . . . Electrospray (ESI),

34 . . . Liquid Sample Ionization Chamber (Ionization Chamber),

37, 39 . . . Ion Guide, 42 . . . Quadrupole Mass Filter of Preceding Stage

The invention claimed is:

1. A quadrupole mass spectrometer, comprising:

a quadrupole mass filter including a pre-rod;

an ionization chamber; and an ion optical system that guides ions generated in the ionization chamber to the pre-rod of the quadrupole mass filter, wherein:

a potential of an exit side electrode of the ion optical system is lower than a potential of the ionization chamber and a potential of the pre-rod of the quadrupole mass filter; and there is no structure that has a higher potential than the exit side electrode and decelerates the ions between the exit side electrode and the pre-rod.

2. The quadrupole mass spectrometer according to claim 1, wherein:

a distance from a central axis of the ion optical system and the quadrupole mass filter to the exit side electrode is equal to or less than half a distance from the central axis to the pre-rod; and a distance from the exit side electrode to the pre-rod is equal to or less than half a length of the pre-rod in the central axis direction.

3. The quadrupole mass spectrometer according to claim 2, further comprising:

a partition wall that separates the ion optical system and the quadrupole mass filter and in which an ion passage hole is formed on the central axis of the ion optical system; wherein:

at least a part of the exit side electrode of the ion optical system is arranged inside the ion passage hole so as to surround the central axis of the ion optical system without contacting the partition wall.

4. The quadrupole mass spectrometer according to claim 3, wherein:

the ionization chamber is a gas sample ionization chamber that ionizes analysis target carried by carrier gas.

5. The quadrupole mass spectrometer according to claim 3, wherein:

the ionization chamber is a CID cell; and the ion optical system guides product ions generated in the CID cell to the pre-rod of the quadrupole mass filter, and further comprising:

a second ionization chamber that generates precursor ions to be supplied to the CID cell;

a second quadrupole mass filter that selects the precursor ions; and a second ion optical system that guides the precursor ions generated in the second ionization chamber to the second quadrupole mass filter.

6. The quadrupole mass spectrometer according to claim 2, wherein:

the ionization chamber is a gas sample ionization chamber that ionizes analysis target carried by carrier gas.

7. The quadrupole mass spectrometer according to claim 2, wherein:

the ionization chamber is a CID cell; and the ion optical system guides product ions generated in the CID cell to the pre-rod of the quadrupole mass filter, and further comprising:

a second ionization chamber that generates precursor ions to be supplied to the CID cell;

a second quadrupole mass filter that selects the precursor ions; and a second ion optical system that guides the precursor ions generated in the second ionization chamber to the second quadrupole mass filter.

8. The quadrupole mass spectrometer according to claim 1, wherein:

the ionization chamber is a gas sample ionization chamber that ionizes analysis target carried by carrier gas.

9. The quadrupole mass spectrometer according to claim 1, wherein:

the ionization chamber is a CID cell;

the ion optical system guides product ions generated in the CID cell to the pre-rod of the quadrupole mass filter; and the quadrupole mass spectrometer further comprises:

a second ionization chamber that generates precursor ions to be supplied to the CID cell;

a second quadrupole mass filter that selects the precursor ions; and a second ion optical system that guides the precursor ions generated in the second ionization chamber to the second quadrupole mass filter.

10. The quadrupole mass spectrometer according to claim 9, wherein:

the second ionization chamber is a liquid sample ionization chamber that ionizes analysis target carried by carrier liquid.

11. The quadrupole mass spectrometer according to claim 9, wherein:

the second quadrupole mass filter has a pre-rod; and a potential of an exit side electrode of the second ion optical system is lower than a potential of the second ionization chamber and a potential of the pre-rod of the second quadrupole mass filter.

12. The quadrupole mass spectrometer according to claim 11, wherein:

the second ionization chamber is a gas sample ionization chamber that ionizes analysis target carried by carrier gas.

* * * * *